United States Patent [19]

Cheshire et al.

[11] Patent Number: 4,543,156

[45] **Date of Patent: * Sep. 24, 1985**

[54] METHOD FOR MANUFACTURE OF A NON-WOVEN FIBROUS WEB

[75] Inventors: James O. Cheshire, Neenah; Douglas L. Lindgren, Appleton; Robert J. Marinack, Oshkosh; Bruce W. Janda, Neenah; Robert S. Thut, Green Bay; John T. Larkey, Green Bay; Ray E. Jostad, Green Bay, all of Wis.

[73] Assignee: James River-Norwalk, Inc., Norwalk, Conn.

[ * ] Notice: The portion of the term of this patent subsequent to Apr. 17, 2001 has been disclaimed.

[21] Appl. No.: 574,287

[22] Filed: Jan. 26, 1984

Related U.S. Application Data

[63] Continuation-in-part of Ser. No. 380,026, May 19, 1982, Pat. No. 4,443,299, which is a continuation of Ser. No. 179,229, Aug. 18, 1980, abandoned.

[51] Int. Cl.[4] ..... D21D 3/00

[52] U.S. Cl. ..... 162/101; 162/190; 162/264; 162/289; 162/301

[58] Field of Search ..... 162/101, 190, 301, 317, 162/264, 289

[56] References Cited

U.S. PATENT DOCUMENTS

| | | | |
|---|---|---|---|
| 2,139,874 | 12/1938 | Berry | 162/131 |
| 3,837,999 | 9/1974 | Chung | 162/101 |
| 3,871,952 | 3/1975 | Robertson | 162/101 |
| 4,049,491 | 9/1977 | Brandon et al. | 162/101 |
| 4,443,297 | 4/1984 | Cheshire et al. | 162/101 |

FOREIGN PATENT DOCUMENTS

| | | | |
|---|---|---|---|
| 1129757 | 10/1968 | United Kingdom | 162/101 |

*Primary Examiner*—Peter Chin

*Attorney, Agent, or Firm*—William A. Aguele; Harry W. Hargis, III; Thomas H. Whaley

[57] ABSTRACT

Apparatus and method for the manufacture of a non-woven fibrous web such as paper from a dispersion of fibers in a foamed liquid in which fiber furnished in a foamed liquid comprising a solution of surfactant in water is discharged from a headbox into the nip of a twin forming wire prior to its passage over a forming roll. The water-surfactant solution is drained from the web and recycled as a foamed liquid containing about 65% air in the form of bubbles of from about 20 to about 200 microns in diameter. The foamed liquid is directed into a mix tank wherein a slurry containing fiber at 20% to 55% solids is added and mixed. The mixture is pumped to the headbox and into the nip of the forming wires.

7 Claims, 2 Drawing Figures

METHOD FOR MANUFACTURE OF A NON-WOVEN FIBROUS WEB

This application is a continuation-in-part of U.S. patent application Ser. No. 380,026, filed May 19, 1982, now U.S. Pat. No. 4,443,299 which is a continuation of U.S. patent application Ser. No. 179,229, filed Aug. 18, 1980, now abandoned.

This invention relates to the forming of paper and other non-woven fibrous webs, such as paper webs, and more particularly to an improved apparatus and method for the formation of such webs from a dispersion of fibers in a foamed liquid by depositing the liquid and fibers on a forming wire and draining the liquid through the wire to leave the fibers thereon in the form of a web.

Among the prior art processes for producing fibrous webs by various foam-forming methods are those disclosed in U.S. Pat. Nos. 3,716,449; 3,938,782; 3,871,952; and 3,837,999 incorporated herein by reference. The present invention provides an improved method and apparatus for the formation of a fibrous web in a foam forming system without the need for a turbulence generating or special foaming device. The method of this invention produces foamed liquid having the desired air content, viscosity, specific gravity, and related characteristics required for forming a fibrous web.

The method of producing improved webs and the improved process of the invention will be more readily understood from a consideration of the following description, taken with reference to the accompanying drawings.

BRIEF DESCRIPTION OF THE DRAWINGS

With reference to FIG. 1 of the drawings, a preferred form of apparatus of the twin-wire type for making a non-woven fibrous web, such as paper, is illustrated wherein reference numerals 11 and 12 designate first and second endless, woven, fluid permeable forming wires of substantially similar weave and type used in the forming of the non-woven webs. Forming wire 11 is supported in a conventional manner on rolls, including those designated generally by the numerals 13, 14, 15, and 16. Similarly, forming wire 12 is supported on rolls of conventional design, two of which are illustrated and designated by reference numerals 18 and 18*a*. The support rolls for forming wires 11 and 12 are so positioned as to cause the wires to converge to form a nip 17 just ahead of cylindrical forming roll 19 as illustrated in FIG. 2. The wires 11 and 12 are driven so that the wrapped portions on forming roll 19 move undirectionally, at the same speed, in the direction of rotation A of roll 19.

As illustrated in FIG. 2, wires 11 and 12 converge on forming roll 19, at slightly different angles, forming a wedge-shaped nip 17 therebetween into which a jet 20 of a foamed liquid-fiber dispersion is directed from a pressurized headbox 21 as illustrated. The surface of roll 19 is smooth and fluid impervious, and wires 11 and 12 are so tensioned that they are operative to squeeze the foamed liquid-fiber dispersion between them to force liquid 20*a* through the wire 11, hereinbelow also referred to as the outer wire. Liquid 20*a* forced through the outer wire 11 is directed through the open inlet port 23 of a saveall 22, and, with the aid of deflectors 22*a*, collected therein as seen at 20*b*. Wire 12, the inner wire on the forming roll, supports web W as it is carried away from the forming roll for drying and further conventional treatment.

Figure 1:
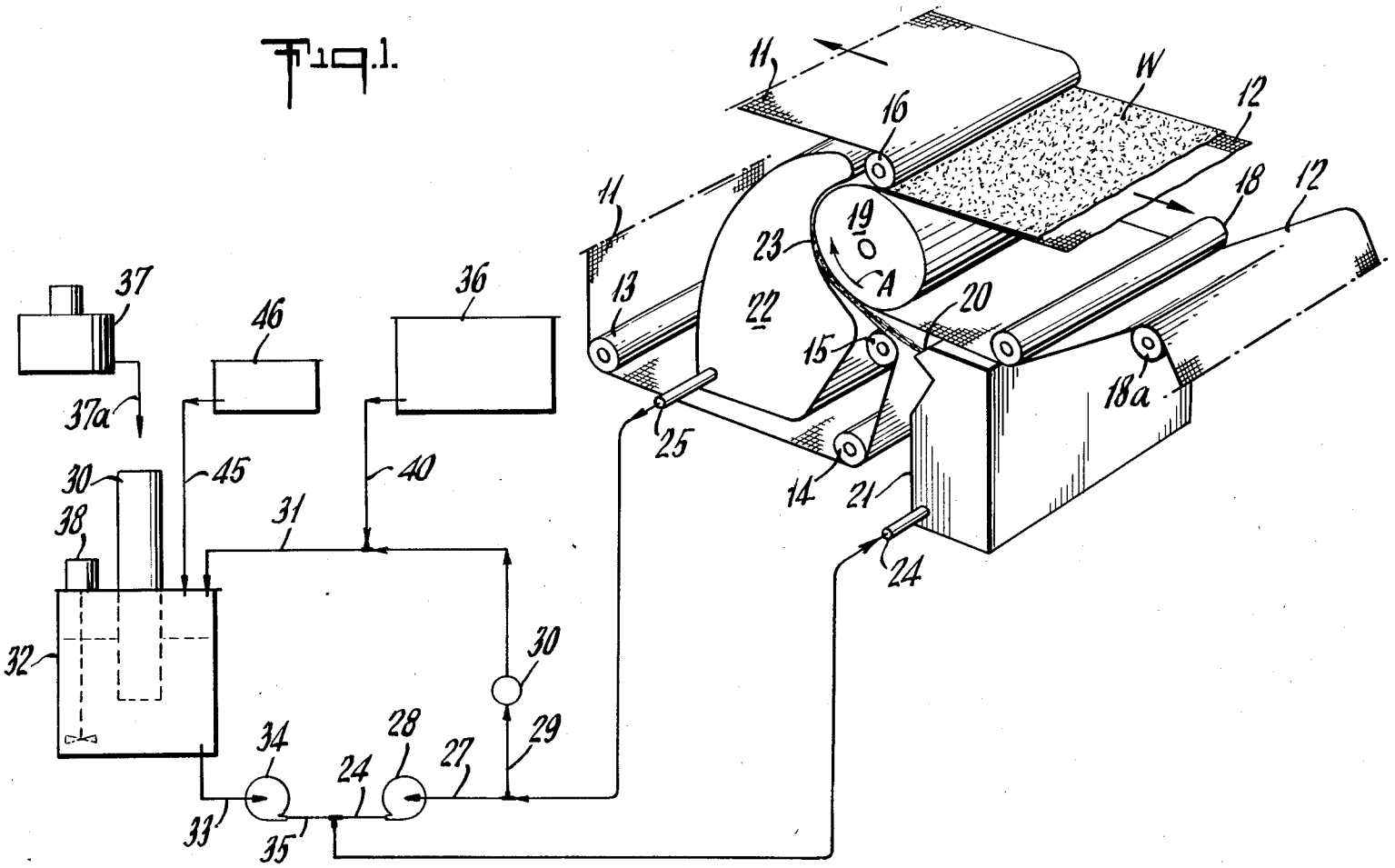
FIG. 1 is a diagrammatic perspective view, with portions fragmented, of apparatus embodying the invention.
Figure 2:
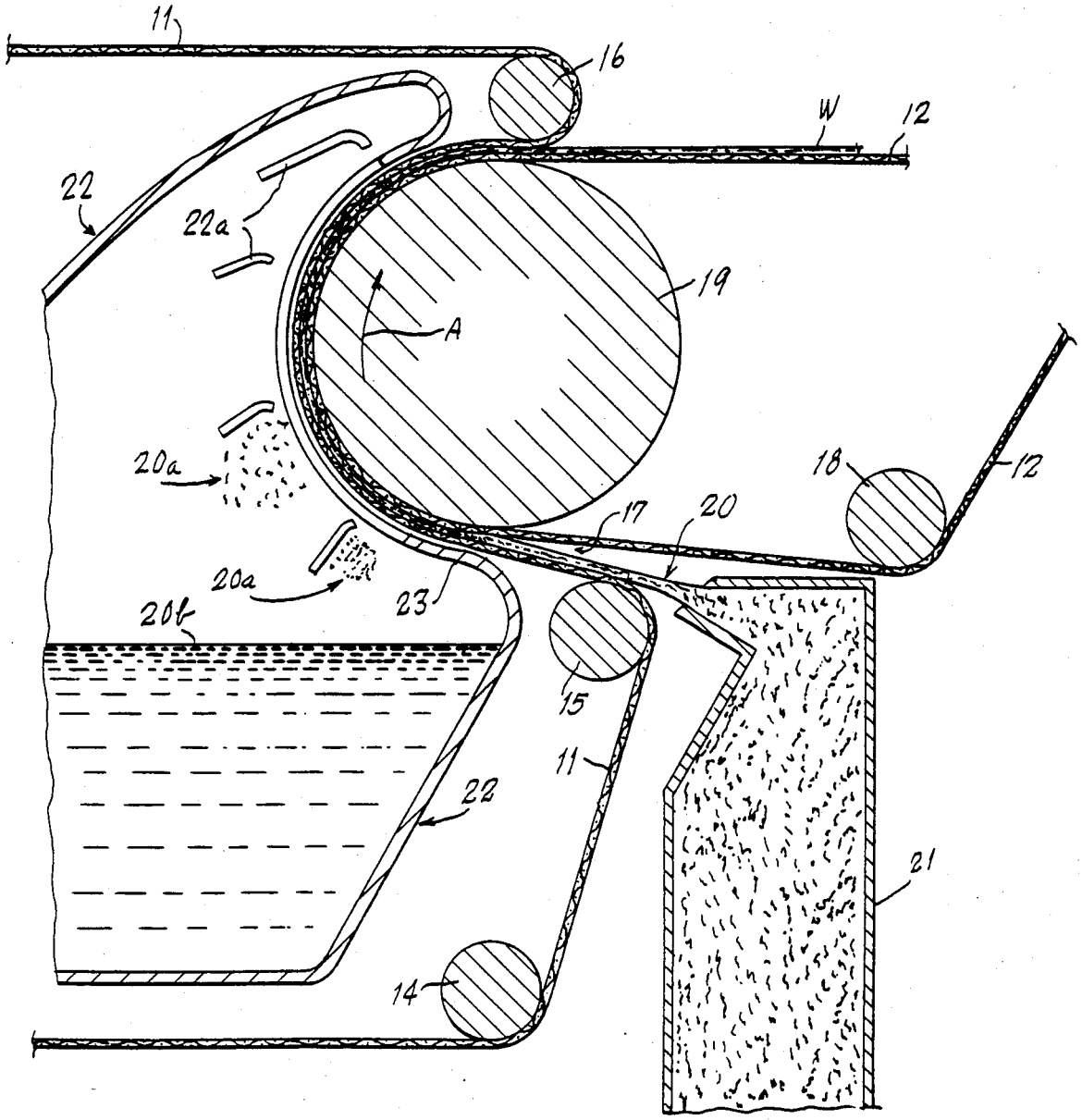
FIG. 2 is a sectional view with portions fragmented taken generally along the line of 2—2 of FIG. 1.

Again with reference to FIG. 1, the foamed liquid and fiber furnish is supplied to headbox 21 through a conduit 24, and the residual liquid removed from the web W is withdrawn from saveall 22 through a conduit 25, to a pump 28 for recirculation through conduit 24 leading to headbox 21. A parallel liquid flow circuit comprises conduit 29 connected to conduit 25, a pump 30, a conduit 31 leading into the top of mix tank 32, and a conduit 33 leading from the bottom of mix tank 32 provided with a pump 34 which a dispersion of fibers in foamed liquid through conduit 35 to conduit 24. A water-surfactant solution is supplied to the mix tank 32 from a source 36 through conduit 40. Pulp comprising fibers of the type used in paper making, is supplied to tank 32 through conduit 30 leading from a de-watering press 37 to which a pulp slurry is supplied from a suitable source (not illustrated). An agitator 38 is positioned in and operative to mix the contents of tank 32. The rate of pulp feed to the de-watering press is controlled to produce webs of the desired basis weight at the production speed of the machine. Typical basis weights are in a range of from about 8 lbs/ream (3000 $ft^2$) to about 38 lbs/ream.

In a typical startup procedure, water from a suitable supply source 46 is introduced into mix tank 32 through supply conduits 45 and 45*a*. A concentrated aqueous solution of surfactant is added to tank 32 through conduit 40 in the amount necessary to provide a predetermined surfactant concentration in mix tank 32 required to produce a foamable liquid capable of producing a relatively stable foam which will support the fibers making up the foamed fiber furnish supplied to the headbox. The mix tank 32 is partially filled, e.g., to about one half to three fourths its capacity, with sufficient foam forming liquid to fill the pumps, conduits, headbox, and saveall when circulation is initiated and to provide a residual volume in the mix tank in the range of one fourth to one third of its capacity. The foamable liquid, which preferably is substantially free from fibers, is passed by pump 28 to and through moving forming wires 11 and 12 whereby foam of the desired consistency is produced by entrainment of air in the foamable liquid passing through the wires. The resulting foamed liquid collects in saveall 22 and is circulated by pumps 28, 30 and 34 to and through the mix tank 32 and forming wires 11 and 12 until the foamed liquid contains from about 55 to about 75 percent air by volume. Fibers are added to the foamed liquid in mix tank 32 and dispersed therein to form a foamed fiber furnish which is supplied through line 24 and headbox 21 to foraminous support 12 for the production of the non-woven fibrous web. An aqueous solution of a suitable anionic surfactant, e.g., an alpha olefin sulphonate available from Arco/Chemicals, Inc. under the trade mark A-OK, has been used successfully at a preferred concentration of about 300 ppm by volume. A number of surfactants suitable as a water additive for purposes of the present invention are available on the market, being generally classified as nonionic, anionic, cationic, or amphoteric.

Selection of a suitable class of surfactant is dependent upon chemical characteristics of such other commonly used additives which may be present in the manufacture of fibrous webs. These other additives include, singly or in homogeneous mixtures thereof, latexes, binders, debonding agents, dyes, corrosion inhibiting agents, pH controls, retention aids, creping aids, and other substances such as are used in papermaking processes.

U.S. Pat. Nos. 3,716,449 and 3,871,952 disclose specific nonionic, anionic, and cationic surfactants that have been found suitable in the art of forming fibrous webs from dispersions of fibers in foam. U.S. Pat. No. 4,056,456 discloses additional surfactants, including some classified as amphoteric, that are suitable for practice of the present invention. The disclosures of these patents are included, by reference, in the present application for their teachings of surfactant materials. It is of course to be understood that there are a number of other additive surfactant materials available, each, as well as those identified, being capable of modifying the interfacial tension between water molecules and gas or air molecules of the liquid.

The forming section is then started, driving the forming wires 11 and 12 at a speed of about 2500 fpm, with the tension of the wires adjusted to a tension in a range of from about 20 pli (pounds per linear inch) to about 60 pli, preferably about 30 pli. The pumps 28, 30, and 34 are energized to pump foamed fiber furnish comprising foamable liquid from saveall 22 and the suspension of fibers in foam from mix tank 32 to headbox 21, from which jet 20 is directed into nip 17 at the juncture of the forming wires 11 and 12. The rotational speeds of pumps 30, 34 and 38 are regulated to establish fluid flow rates through the system which result in a preferred materials balance at typical flow rates, pump 28 handles about three fourths of the desired volume of flow to the headbox 21 while pump 34 handles the remainder. Pump 30 is regulated to maintain a substantially constant level in mix tank 32. The flow rate of foamed fiber furnish is regulated to achieve a jet velocity in the range of from about 90% to about 150% of the speed of the forming wires. Usually a jet velocity of about 110% of the speed of the wires is preferred. Forming wire speeds may be in the range of from about 1000 fpm to about 7000 fpm, or more, depending upon the operating conditions and the physical properties of the foamed fiber furnish and the forming wires.

When the foamed fiber furnish impinges on the forming wires 11 and 12, the furnish is uniformly distributed over the width of the wires. As the outer wire 11 converges with the inner wire 12, at nip 17, pressure is applied to the furnish which, combined with the force of liquid jet 20, causes the foamable liquid to flow through interstices of outer wire 11. The inner wire 12 has its interstices closed to fluid flow by the underlying solid surface of forming roll 19. As the expressed foamable liquid passes through the outer wire, air travelling with the wire as well as air in its interstices is entrained, thereby generating foam in the foamable liquid so that, once started, the foam generation (or regeneration) is a self sustaining operation.

Foam 20*a* is collected in saveall 22 and directed to the mix tank 32 via conduits 25, 29 and 31 and to headbox 21 by way of conduits 25, 27, and 24. The method of generating and regenerating foam is so effective that no other means of foam generation is required. In test operations, starting up without any fiber addition to mix tank 32, during an operating period of about 5 minutes, the air content of the foamable liquid increased from nearly zero to a preferred value of about 67 volume percent. Maximum bubble size of the foam during operation is, for example, in a range from about 20 microns to about 200 microns, which is less than the lengths of the suspended fibers. Optimum relationships of bubble dimension to fiber dimensions are dealt with in the referenced U.S. Pat. Nos. 3,716,449 and 3,871,952, and are readily achieved by the apparatus and method of the present invention.

A pulp of papermaking fiber in water is prepared conventionally to a consistency about 1.0 to 4.0% fiber by weight. A well mixed dispersion of the fiber in water is obtained by high shear agitation as is well known in the art. The pulp may be prepared as part of an integrated mill operation, or may be made by repulping laps, bales or rolls of dried untreated fibers. In the latter case of a repulping operation, a uniform fiber slurry is obtained by vigorous mixing for at least 15 minutes, preferably 30 minutes or longer. Typically, the pulping operation is performed batchwise, the slush pulp being subsequently stored in a machine chest (not illustrated) having storage capacity sufficient for three to six hours or more of normal operation to provide a continuously available supply of pulp.

In the process of this invention, slush pulp from a suitable source (not illustrated) is dewatered in a stock press 37 and then introduced into mix tank 32. Leaving the stock press 37 through line 37*a*, the pulp has a consistency sufficient to require the addition of makeup water and surfactant solution to the system via lines 40 and 40*a* respectively. A suitable stock-press is available from Arus-Andritz. The desired consistency of the pulp in line 37*a* can be calculated easily by material balance on the basis of limiting the loss of surfactant from the system to that amount inevitably carried away in the wet web 12. In general, the pulp consistency is between 8 and 50 weight percent fiber, preferably between 15 and 35 weight percent. Water removed by press 37 may be recycled. The dewatered high consistency pulp from line 37*a* is introduced to the mix tank 32 well below the liquid level therein at a rate dependent upon the material balance. About 4 to 22 pounds of surfactant per ton of dry fiber in web W is lost from the system and is made up through lines 40 and 40*a*.

While the hereinabove described cyclic operation continues, fiber is introduced from the dewatering press 37 to mix tank 32 at a rate corresponding to the desired web production rate. A slurry of about 3 weight percent fibers normally is fed to press 37, and a slurry of from about 25 to about 50 weight percent, preferably about 35 weight percent fibers, leaves the press 37 as feed to mix tank 32. If desired, dry fibers may be introduced directly to the foamed liquid in mix tank 32 in suitable proportions for achieving desired basis weights. With all pumps energized, the foam-fiber mixture is directed by pump 34 from mix tank 32 through conduits 33 and 35 into conduit 24, where it combines with foamed liquid from saveall 22, through conduits 25, 27 and 24, and the resulting foamed fiber furnish supplied to headbox 21 from which it is fed onto wires 11 and 12. Fibers and some of the liquid remain on the wires forming the product web. The major portion of the foamable liquid passes through wire 11. Foam is regenerated by air from the wires as explained above. Control of air content of the foam is achieved by controlling the amount of surfactant added to the system in mixing tank 32.

In operation, a balance of air loss through foam degradation and air gain through regeneration is necessary to maintain proper foam air content and bubble size. The surfactant concentration is the primary factor determining the rate of foam degradation. The bubble size of the foam becomes the primary controlling factor on air gain through regeneration. The bubbles in the 20 to 200 micron size are significantly smaller than the openings in the weave of the forming wire thus passing through without the fluid film surrounding the bubble being broken into smaller bubbles. Bubbles of 20–200 micron size thus expell the air in the forming wire interstices without excessive foam generation.

Another naturally occurring phenomenon assists air content control. When the air content of the foam exceeds 67% air by volume, the foam becomes progressively more viscous with increasing air content. As the viscosity of the foam increases, it becomes more difficult to remove from the web. Thus more surfactant is lost from the system with the web as it is formed tending to restore the surfactant concentration balance.

The actual concentration of surfactant needed is a function of many variables and is best determined by trial. Some of the variables are surfactant type, water hardness, water temperature, furnish ingredients and circulation time in the system.

A loss of foam occurs following the introduction of fiber and its deposition on the forming wires, since liquid is removed from the system with the fibrous web. The foamable liquid lost in this manner is continuously replenished, the water being replenished by water contained in the pressed pulp from press 37 supplemented by water supplied through conduit 45 and the surfactant solution replenished through supply conduit 40. The relative proportions of water and concentrated surfactant solution are suitably regulated to maintain air content of the foam in the desired range of from about 55 to about 75 percent. For example, in test runs, a concentration of about 340 ppm of an alpha olefin sulfonate (Arco A-OK) in water in the circulating foamable liquid was sufficient to maintain the air content in the foamed liquid at a preferred value of about 67% air by volume. It is well known in the art, as exemplified by the referenced U.S. Pat. Nos. 3,716,449 and 3,871,952, that air contents below about 55% are conducive to fiber agglomeration, and air contents above about 75% are conducive to fiber bundling, both undesirable.

Foamed liquid from the saveall 22 is transferred by pump 30 through lines 25, 29 and 31 to mix tank 32. Pump 30 preferably is of the twin screw type capable of transferring low density liquids such as the foamed liquid. The volume of foamed liquid thus transferred is that amount necessary to obtain a mix tank consistency of between about 0.3 to about 4 percent fiber by weight, preferably between 1.5 to 4 percent. An agitator 38 provides the requisite energy to disperse the fibers in the foamed liquid. The foamed liquid furnish leaves the mix tank 32 by line 33, a twin screw pump 34 providing the motive energy therefor. The discharge from pump 34 through line 35 is passed through line 24 to headbox 21.

In a preferred embodiment, that is, where the mix tank consistency is between 1.5 to 4.0 percent fiber by weight, additional foamed liquid is pumped from the saveall 22 by twin screw pump 28 through line 24, and is combined with the mix tank discharge line 35, the combined streams flowing through line 24 to headbox 21. The flow rates in lines 24 and 35 are such that the furnish of line 24 is diluted to a final (headbox) consistency of between about 0.3 to about 1.2% by weight. Where the mix tank consistency is less than 1.2% fiber by weight, further dilution is not required.

In mix tank 32, the foamed liquid has substantially the same air content and bubble size quality as in the foam recovered in saveall 22 as the amount of water added with the untreated fibers through line 45 is minor in comparison to the water in recycled foamed liquid added through line 31. At the viscosity values of the foamed liquid in mix tank 32, the fibers from press 37 can be dispersed rapidly.

At a consistency above 1.5% in mix tank 32, several advantages are realized. First, the size of the mix tank and accompanying equipment is reduced, the ability to rapidly disperse the fibers enhanced, and mixing energy is reduced. The foamed liquid is subjected to shearing action in the mixer 38 which helps maintain fine foam structure while, at the same time, the fibers are subjected to less intensive shearing action than in a conventional water dispersion system so that less alteration of the fiber structure takes place. Consistency of the foamed liquid is ensured by blending the dispersion of fibers in foamed liquid from mix tank 32 with foamed liquid from line 24 to that in line 35 is in the range of from about 6:1 to about 1:1 in the preferred process embodiment. Hence, when foam from line 27 is combined with the dispersion from mix tank 32, the foamed liquid in line 24 will have substantially the same quality as that in the saveall 22.

The final (headbox) furnish in line 24 is at a consistency of about between 0.3 to about 1.2% fiber by weight, and has a viscosity of about 10 cps (centipoises) to about 35 cps on a fiber free basis. Because of the head induced by pumps 38 and 34, the bubble size of the foamed liquid, which is a compressible fluid, is reduced to about 20 to about 200 microns, the averaging bubble size being in the range of about 50 to about 100 microns. The bubble size increases as pressure decreases during passage of the foamed liquid through line 24. The pressure drop through nozzle 22 is generally in the range of about 5 to 25 psi (pounds per square inch), and is a function of the jet velocity. As the foam expands across the nozzle, the bubbles become larger and the density and viscosity of the foam decreases. The fibers are distributed randomly but uniformly between the wires 11 and 12 in nip 17 to produce a web having a high degree of uniformity of fiber distribution as indicated by visual inspection of the web.

The pressure and flow rate of the furnish is regulated to achieve a jet velocity from nozzle 22 of from about 90% to 150% of the speed of the forming wires. Typically, the speed of the jet is about 110% of the speed of the wires. Forming wire speeds in the range of from about 1000 fpm to about 7000 fpm or more are desirable and suitable for the process.

As the foamable liquid impinges on the forming wire 11, it is distributed over its surface without combing or dragging of the foamed fiber furnish relative to the wires thereby avoiding striation of the fibers and resulting in a product having good tensile strength in all directions. Striation or orientation of the fibers in the direction of travel of the wires which occurs in some prior art systems results in a finished web having high tensile strength in the machine direction but with near minimum tensile strength in the cross-machine direction.

Control of air content is achieved by maintaining a predetermined concentration of surface active agent in the foamable liquid. The requisite concentration of surfactant depends on many factors including the particular choice of surfactant, the temperature of the system, the hold up time, i.e. time required to make one complete cycle of foam through the system and the speed of the wires, and is best determined for any given system by trial. By controlling the surfactant concentration, other factors remaining constant, the air content of the foam can be held substantially constant without the need for a foam generating device or for metering of air by separate means.

We have discovered that the air content of the foamed liquid can be readily controlled without the need for a foaming device by varying the concentration of the surface active agent in the foamable liquid. The foamed liquid comprises air, water and surfactant. The properties of the foamed liquid are dependent on air content, ranging between 55 and 75% by volume; the bubble size, ranging between 20 and 200 microns in diameter, and the surfactant selection. The surfactant may be anionic, nonionic, cationic or amphoteric, provided it has the ability to generate a foamed dispersion. A preferred ionic surfactant is an alpha olefin sulfonate marketed under the trade name "Ultrawet A-OK", by Arco Chemical Company, Philadelphia while a preferred non-ionic surfactant is a peg-6 lauramide, marketed under the trade name "Mazamide L-5AC") by Mazer Chemical Co., Chicago. The concentration of surfactant in the system is about 150 to 450 ppm (parts per million) by weight, and varies within the process.

Prior to start-up of the paper machine desired product specifications and operational parameters of basis weight, machine speed, headbox consistency and headbox jet speed are determined. The adjustments to the headbox slice opening, pump speeds and machine drive speed are thus calculated in advance.

As a specific example, the production of a web of 9 pounds per ream basis weight at a wire speed of 3,000 feet per minute with a headbox consistency of 0.7% and a jet velocity of 110% of wire speed, the following adjustments are made:

Headbox slice opening—0.230 inch
Headbox flow rate—474 gallons per minute per foot (gpm/ft) of machine width
Wire speed—3000 feet per minute
Pump 28—253 gpm/ft of machine width
Pump 34—221 gpm/ft of machine width
Stock flow to dewater press—9 lb fiber/min/ft of machine width The resulting product web is very uniform in appearance and texture and has adequate tensile strength in both the machine direction and in the cross-machine direction indicating substantially random orientation and distribution of fibers in the web.

We claim:

1. A method for making a non-woven fibrous web from a foamed fiber furnish wherein said furnish is distributed on a moving foraminous support from a pressurized headbox which comprises:

a. forming a foamed fiber furnish containing 0.3 to 1.2 weight percent fibers by dispersing fibers in foamed liquid from step d comprising water and a surface active agent and containing 55 to 75 percent air by volume;

b. supplying said foamed fiber furnish from step a comprising said foamed liquid to said headbox and onto said foraminous support without further foam generation treatment with the production of a non-woven fibrous web and simultaneous regeneration of foamed liquid passing through said support by entrainment of additional amounts of air therein;

c. collecting said regenerated foamed liquid after passing through said support, said regenerated foamed liquid containing from about 55 to about 75 percent air by volume; and d. returning collected foamed liquid from step c directly to step a as the source of foamed liquid for the preparation of said foamed fiber furnish.

2. A method according to claim 1 wherein said air in said foamed liquid making up said foamed fiber furnish is in the form of bubbles having an average diameter in the range of from about 20 to 200 microns.

3. A method according to claim 1 wherein water and surfactant are added to said collected foamed liquid in an amount sufficient to make up losses in the system and in relative proportions sufficient to maintain the concentration of the surface active agent in the foamed liquid at a level sufficient to maintain the air content of said collected foamed liquid within the range of 55 to 75 percent by volume.

4. A method according to claim 1 wherein said fibers dispersed in said foamed liquid is a dewatered pulp containing 25 to 50 weight percent fiber.

5. A method according to claim 4 wherein said dewatered pulp contains about 35 weight percent fibers.

6. A method according to claim 1 wherein said fiber is dispersed in a first portion of said collected foamed liquid to form a dispersion of fiber in foam containing 1.5 to 4.0 percent fibers by weight and said dispersion is blended with a second portion of said collected foamed liquid in an amount sufficient to produce said foamed fiber furnish containing from about 0.3 to about 1.2 percent fibers by weight supplied to said headbox.

7. A method of starting up a system for making non-woven fibrous webs from a foamed fiber furnish comprising fibers dispersed in an aqueous foam containing from about 55 to about 75 percent air by volume which comprises:

a. preparing a foamable liquid comprising water and a surface active agent;

b. passing said foamable liquid from step a substantially free from fibers to and through a moving foraminous support web-forming means whereby foam is produced in said liquid by entrainment of air therein producing a foamed liquid;

c. collecting foamed liquid passing through said foraminous support;

d. recirculating said collected foamed liquid from step c to and through said foraminous support until said foamed liquid contains from about 55 to about 75 percent air by volume and is capable of supporting and transporting fibers as a dispersion therein;

e. forming a foamed fiber furnish by dispersing fibers in said foamed liquid from step d; and f. supplying said foamed fiber furnish to said foraminous support for the production of said non-woven fibrous web.

* * * * *